United States Patent [19]

Harbolt et al.

[11] Patent Number: 5,033,494

[45] Date of Patent: Jul. 23, 1991

[54] PROCESS FOR THE VOLUMETRIC TRANSFER OF LIQUIDS

[75] Inventors: Bruce A. Harbolt, Northridge; Perry L. Murata, Torrance, both of Calif.

[73] Assignee: Union Oil Company of California, Los Angeles, Calif.

[21] Appl. No.: 512,085

[22] Filed: Apr. 11, 1990

Related U.S. Application Data

[63] Continuation of Ser. No. 213,901, Jun. 30, 1988, abandoned.

[51] Int. Cl.[5] ..... F17D 1/12

[52] U.S. Cl. ..... 137/1; 137/209; 137/351

[58] Field of Search ..... 137/206, 209, 1, 14, 137/899, 351; 417/118, 122, 125, 137; 222/394

[56] References Cited

U.S. PATENT DOCUMENTS

| | | | |
|---|---|---|---|
| 1,362,858 | 12/1920 | Engles | 417/137 |
| 1,862,407 | 6/1932 | Keith | 417/122 |
| 2,669,941 | 2/1954 | Stafford | 417/125 |
| 3,330,218 | 7/1967 | Bumstead | 417/137 |
| 3,552,884 | 1/1971 | Faldi | 417/122 |
| 3,872,655 | 3/1975 | Davis, Sr. | 56/27.5 |
| 4,059,195 | 11/1977 | MacDonald et al. | 214/44 |
| 4,200,414 | 4/1980 | Link | 406/63 |
| 4,339,277 | 7/1982 | Schult | 106/275 |
| 4,422,833 | 12/1983 | Miller et al. | 417/183 |
| 4,466,760 | 8/1984 | Feldsted | 406/41 |

OTHER PUBLICATIONS

"America's Highways: Searching for Innovation", by Harold H. Weber, Sulphur Research & Development, vol. 9, 1985.

"Sulphur, Sulphur Dioxide and Sulphuric Acid", by U. H. F. Sander, H. Fischer, U. Rothe, and R. Kola (English Edition Prepared by A. I. More), The British Sulphur Corporation Ltd., 1984.

*Primary Examiner*—Alan Cohan

*Attorney, Agent, or Firm*—Clark E. DeLarvin; Gregory F. Wirzbicki

[57] ABSTRACT

Apparatus is provided for transferring a liquid, particularly liquids, such as molten sulfur which are difficult to handle, from a liquid supply, such as a molten sulfur tank truck, to another location, such as a pug mill in which a sulfur/asphalt pavement material is blended. The apparatus comprises a relatively small transfer vessel, which is connected, through a shutoff valve, to the liquid for receiving a gravity flow of liquid therefrom, and an air compressor for pressurizing the transfer vessel through a pressurized air conduit. A check valve installed in the transfer vessel adjacent the liquid inlet of the vessel prevents the trasfer of liquid from the vessel back into the supply when the vessel is pressurized. An electrically-controlled valve in the pressurized air conduit enables an associated control unit to control the flow of pressurized air into the vessel. When the vessel is connected to the source and is unpressurized, liquid flows from the source into the vessel through the check valve; pressurization of the vessel by the compressor then closes the check valve and forces the liquid contained in the vessel out of the vessel and to the other location. An elevated loop in the pressurized air conduit prevents liquid from the liquid supply or the vessel from flowing into the compressor. A corresponding process is provided for transferring a liquid, in discrete amounts or "slugs," from a liquid supply to another location.

26 Claims, 1 Drawing Sheet

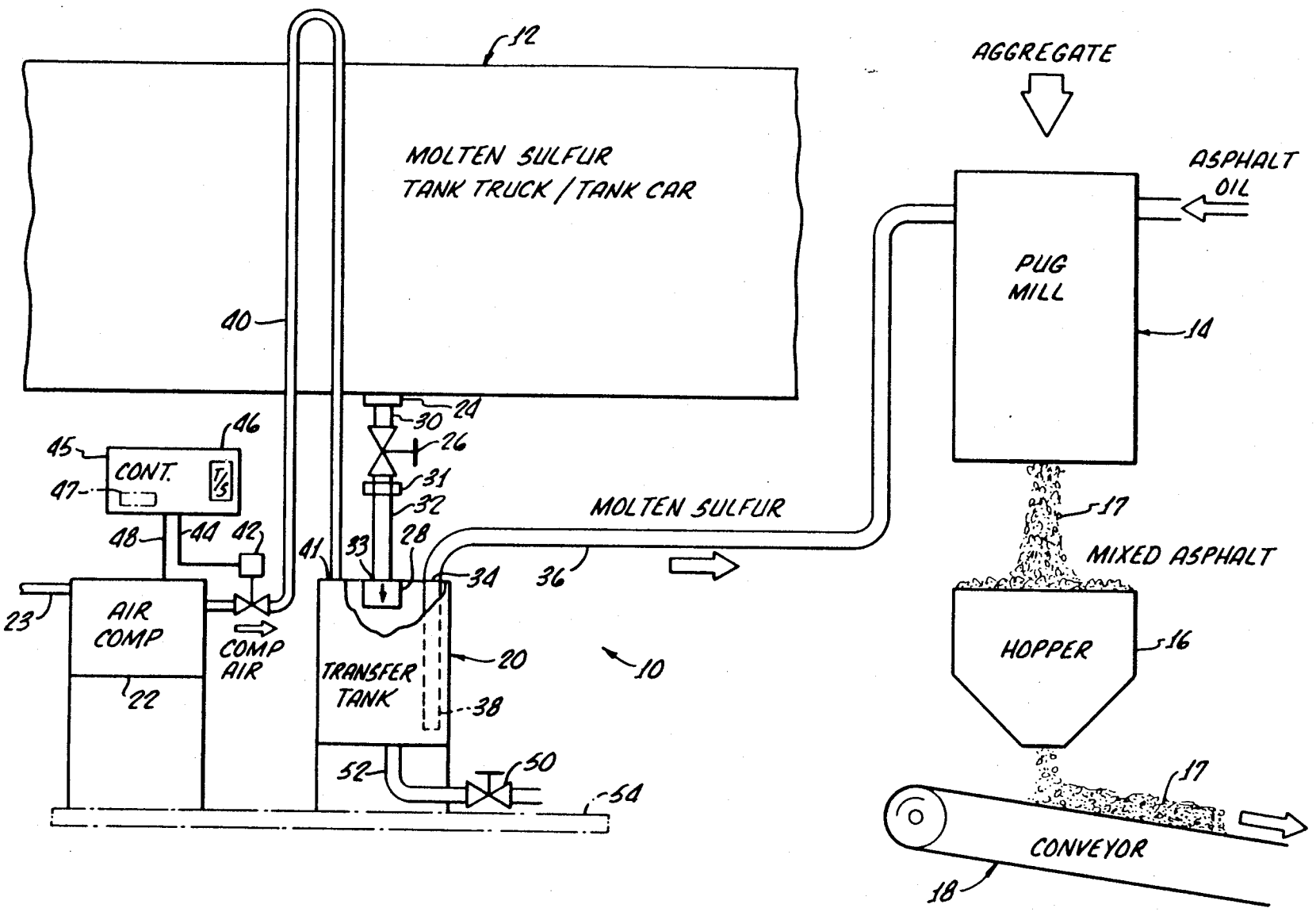
ASPHALT OIL
14
AGGREGATE
PUG MILL
17
MIXED ASPHALT
16
HOPPER
17
CONVEYOR
18
MOLTEN SULFUR
MOLTEN SULFUR TANK TRUCK / TANK CAR
12
10
36
54
50
20
38
34
24
26
30
31
32
28
33
TRANSFER TANK
52
41
40
46
42
COMP AIR
44
CONT.
48
AIR COMP
22
45
47
23

PROCESS FOR THE VOLUMETRIC TRANSFER OF LIQUIDS

This application is a continuation of application Ser. No. 07/213,901, filed June 30, 1988 now abandoned.

BACKGROUND OF THE INVENTION:

1. Field of the Invention

The present invention relates generally to an apparatus and process for transferring liquids, especially liquids, such as molten sulfur, which are difficult to handle, from one location or container to another by the use of a pressurized gas.

2. Background Discussion

Sulfur is the fifteenth most common terrestrial element and is of great commercial importance. According to published statistics, about 9.8 million tons of sulfur were produced in the United States in 1986, about 49 percent of which was used—principally in the form of sulfuric acid—for industrial purposes, including the production of petrochemicals, plastics and fibers. Another 25 percent of the produced sulfur was used for inorganics and pigments, and about 12 percent for non-chemical purposes, such as plating. The remaining 14 percent or so of the produced sulfur was used, indirectly or directly, in agriculture—about 9 percent as sulfuric acid for the production of phosphate fertilizers and the remaining 5 percent for application to crops and the like.

Unlike most elements, sulfur is produced by both "voluntary" and "involuntary" means. In "voluntary" production, sulfur is intentionally mined and produced from naturally-occurring ores or deposits, with such production being entirely discretionary on the part of the sulfur producers. By contrast, in "involuntary" production, sulfur is produced as a necessary by-product of other processes, or from the manufacture of other products. Consequently, involuntary sulfur production depends upon the market for the other processes or products and not upon the demand for sulfur.

With regard to the involuntary production of sulfur, large quantities of elemental sulfur are, for example, obtained from unwanted hydrogen sulfide and/or sulfur removed from natural gas, crude oil, and geothermal fluids during the production, processing, or use of these fluids. Natural gas, for example, typically contains between about 15 and 30 percent of hydrogen sulfide which must be removed, to meet pollution standards, before or during use of the gas. Moreover, in addition to usually containing some hydrogen sulfide, crude oils typically contain between about 0.1 and 2.8 percent of elemental sulfur, with some "sour" oils having over a 3 percent sulfur content; most of this sulfur must be removed from the crude oil during its refining.

More than half the sulfur presently produced in the United States is produced involuntarily. For example, of the approximately 9.8 million tons of sulfur produced in the United States in 1986, only about 4.0 million tons were "voluntarily" produced, mainly by the Frash process. Of the remaining 5.8 million tons of "involuntary" sulfur, about 2.24 million tons were reportedly produced as a by-product of cleaning natural gas.

This high percentage of involuntarily-produced sulfur can and does cause substantial upsets in the sulfur market. In the early 1970s, for example, the Mideast oil embargoes forced a greatly increased reliance on higher sulfur-content, "sour" crude oils from other regions of the world. As a consequence, involuntary sulfur producers (principally in the oil and gas industry) accumulated huge surpluses of sulfur, thereby causing a worldwide sulfur surplus and a substantial decrease in the market value of sulfur. The curtailing of voluntary sulfur production and the resumed usage of lower sulfur-content oil has since reduced these huge sulfur surpluses of the early 1970s; nevertheless, sulfur surpluses still, from time to time, occur. More recent surpluses of sulfur have, for example, been caused by such factors as the diminished demand for sulfur for producing phosphate fertilizers (due to improved crop strains and the over-productions of food in many countries) and the still-increasing use of sour oil from Texas, Mexico, and Venezuela.

Mainly because of such sulfur surpluses, new and/or expanded uses for sulfur have been sought in order to stabilize the sulfur market. Most of the new or proposed new, uses for sulfur are for structural materials, principally: (i) sulfur-asphalt compositions for road building, (ii) rigid sulfur foams for thermal insulation, and (iii) sulfur-based concrete for special applications in which the properties of conventional, portland cement-based concretes are inadequate.

Regarding the combining of sulfur with asphalt—with which the present invention is indirectly concerned—it has been well known for over a century that sulfur can improve the properties of asphalt compositions. For example, the addition of sulfur to asphalt can result in the increased stability of asphalt pavements (macadam), and in reduced pavement rutting, washboarding, and deflections. However, only in recent years have the necessary techniques been developed to the extent that sulfur and asphalt can be combined in a practical manner.

Sulfur can be incorporated into asphalt for paving in either of two principal ways, each of which has a different purpose. One such way is to incorporate molten sulfur in a hot mix; the other way is to produce an asphalt/sulfur emulsion. By adding about 13 percent of sulfur in the hot mix asphalt process, most or all of the generally costly (and increasingly scarce) rock aggregate, which would normally be used in the paving material, can be replaced with much less costly, and more readily available, sand. Although the added sulfur increases the fluidity of the hot mix, when the mix cools the sulfur solidifies and contributes to the mechanical stability of the mixture.

In the sulfur/asphalt emulsion process, molten sulfur replaces some of the asphalt oil binder, which is usually more costly than sulfur. Such so-called "sulfur-extended asphalts" typically contain 30 to 50 percent of sulfur which may be emulsified into the asphalt by a special mixer.

Other processes for using sulfur as a replacement for asphalt in a plasticized sulfur composition have reportedly been developed for the U.S. Federal Highway Administration and tested by the U.S. Bureau of Mines. These plasticized sulfur compositions contain substantial amounts of such plasticizers as dicyclopentadiene. However, the high cost of the plasticizers is presently impeding significant development of the material.

Along with the interest of the sulfur industry in developing new uses and markets for sulfur, a Strategic Highway Research Program (SHRP) has recently been established in the United States to provide carefully targeted research toward improving highway materials and pavement performance so as to preserve the trillion dollar investment in United States highways. One specially targeted area of research for the $150 million, 5-year study program by SHRP is asphalt, since of the slightly over 2 million miles of paved highways in the United States, nearly 1.9 million miles consist, at least in part, of asphaltic materials. In this regard, about 30–35 million tons of asphalt paving material are reportedly used each year just in the State of California.

One of the problems associated with the use of molten sulfur for such purposes as compounding asphalt paving materials is that sulfur has a fairly high melting point of 115.2° C. (about 240° F.). Relatively costly systems are, therefore, presently required for storing and transferring molten sulfur, which is commonly delivered to a road-building site in liquid form by tank trucks typically containing about 23 to 24 tons (about 3200 gallons) of sulfur. Moreover, such molten sulfur handling and transferring systems are required to be mobile to the extent they can be advanced along a roadway with other equipment as the sulfur/asphalt pavement composition is applied. To keep the sulfur in its molten state, such systems typically require a steam-jacketed tank for storing the molten sulfur, a boiler for generating steam for the steam jacket, and a pump and piping for continuously recirculating molten sulfur through the discharge pipe used to deliver the sulfur to apparatus in which the sulfur is to be mixed when needed. Some type of molten sulfur metering or weighing equipment is additionally required so that the proper amount of molten sulfur can be mixed with asphalt and aggregate or sand to make the sulfur/asphalt paving material.

The relatively high cost of such molten sulfur handling and transfer systems—the estimated cost for each such system is between about $50,000 and about $100,000—tends to make it difficult to generate great interest in the use by paving contractors of sulfur as an asphalt pavement component, particularly since there is not presently a large surplus of sulfur and its cost is not particularly low.

SUMMARY OF THE INVENTION

To eliminate the need for large, costly, on-site molten sulfur storage and handling equipment, and to thereby encourage the use of sulfur in the asphalt paving industry, the present inventors have developed a relatively compact, inexpensive—yet very efficient and effective—apparatus. The present apparatus enables molten sulfur to be rapidly transferred from a delivery vehicle, in small, discrete "slugs," to an existing asphalt mixing apparatus (pug mill) used for blending asphalt oil and aggregate into a paving material.

There is accordingly provided, in accordance with the present invention, an apparatus for transferring a liquid, particularly a liquid, such as molten sulfur, which is difficult to handle, from a liquid supply to another location. The apparatus comprises a transfer vessel or tank having a liquid inlet and outlet, the inlet being connected to the liquid supply and adapted for receiving a gravity flow of liquid therefrom. Means, preferably a check valve, are provided for permitting the liquid to flow from the liquid supply into the transfer vessel while blocking the flow of the liquid from the transfer vessel back to the liquid supply.

The apparatus further includes means, preferably comprising an air compressor and a pressurized air conduit, for providing a flow of pressurized gas to the transfer vessel to force liquid contained therein out through the vessel outlet and to the other location. Preferably included are means for controlling the flow of pressurized gas to the transfer vessel. Also in the preferred embodiment, the pressurized air conduit is adapted to have a portion thereof extend above the level of liquid in the liquid supply to prevent the liquid from the supply and/or the transfer vessel from flowing into the compressor.

A corresponding process is provided for transferring a liquid, preferably a difficult-to-handle liquid, and most preferably molten sulfur, from a supply to another location. The most preferred process comprises the steps of: (i) connecting an inlet of a transfer vessel to a supply of molten sulfur and an outlet of the transfer vessel to a location other than that of the supply, (b) flowing, under gravity, molten sulfur from the supply into the transfer vessel, and (iii) pressurizing, with a pressurized gas, the transfer vessel so as to force molten sulfur contained in the vessel out through an outlet and to the other location. The process includes the step of preventing the flow of molten sulfur from the inlet of the transfer vessel back to the supply of molten sulfur and from the supply and the transfer vessel to the source of pressurized gas.

It is preferred that the volume of the transfer vessel be substantially smaller than the volume of the molten sulfur supply, the process then including repeating, in sequence, the steps of flowing molten sulfur from the molten sulfur supply into the transfer vessel and of pressurizing the transfer vessel to transfer the molten sulfur in the vessel to the other location, thereby causing molten sulfur to be transferred from the supply to the other location in a series of small, discrete slugs, each of which preferably has the same volume.

BRIEF DESCRIPTION OF THE DRAWING

The present invention can be more readily understood from the following detailed description when taken in conjunction with the accompanying drawing in which there is depicted (in schematic form) a volumetric transfer apparatus, in accordance with the present invention, for transferring molten sulfur or the like from a supply (for example a delivery tank truck) to a point of use (for example an asphalt-mixing pug mill). In the drawing, a molten sulfur transfer tank, which comprises part of the apparatus, is shown partially cut away so that a flow check valve disposed in the tank can be seen.

DESCRIPTION OF THE PREFERRED EMBODIMENT

There is schematically depicted in the drawing a volumetric liquid transfer apparatus 10, according to the present invention. By way of illustrative example, volumetric liquid transfer apparatus 10 is connected for incrementally transferring molten sulfur, in specific, known, relatively small amounts or slugs, from a delivery tank truck (or other delivery vehicle) 12 to a pug mill 14 wherein, as described below, the molten sulfur is combined with asphalt oil and aggregate to compound batches of a material suitable for paving roads, parking lots, and the like. Located beneath pug mill 14 is a hopper 16 into which the pug mill discharges batches of mixed sulfur/asphalt/aggregate paving material 17. From hopper 16, paving material 17 is discharged onto a conveyor 18 which delivers the paving material to a point of use or to a storage area (not shown). Alternatively, conveyor 18 may be eliminated to enable hopper 16 to discharge mixed sulfur/asphalt paving material 17 into trucks (not shown) for delivery to a paving site.

It is, however, to be appreciated that apparatus 10 of the present invention is not limited to the transfer of molten sulfur between delivery tank truck 12 and pug mill 14, nor is the present invention even limited to the transfer of molten sulfur. Thus, the apparatus of the present invention may be advantageously used for the measured (volumetric) transfer of any type of liquid, but especially those liquids which are difficult to handle—such as liquids having high viscosities or high melting points, or which are highly corrosive—because no complicated parts, such as flow meters and pumps, having continually moving parts, are needed. Another important advantage of apparatus 10 is that, as described below, the apparatus is self cleaning after use, making it additionally advantageous to use with difficult-to-handle liquids.

Shown comprising transfer apparatus 10 are a relatively small volume transfer vessel or tank 20 (which is positioned at a lower elevation than the liquid discharge point of tank truck 12) and an air compressor or other source (such as a pressure tank) of pressurized air (or gas) 22, the latter preferably having a pressure relief conduit 23. Connected in liquid flow series between a fitting 24 at the bottom of tank truck 12 and the top of vessel 20 are a manual shutoff valve 26 and a one-way, check valve 28 which permits the flow of molten sulfur from the tank truck into the vessel, but not from the vessel back into the tank truck. As will be apparent from the following description, check valve 28, which may be of a simple, flapper-type, as is known in the art, has the only moving part in the molten sulfur flow path through apparatus 10.

Shutoff valve 26 is ordinarily an existing part of tank truck 12 (and is not, therefore, usually part of transfer apparatus 10), being mounted directly to fitting 24, or a short conduit 30 extending downwardly therefrom. Liquid transfer apparatus 10 includes a fitting 31, upstream of check valve 28, which enables liquid transfer apparatus 10 to be connected, through shutoff valve 26, to tank truck 12. A conduit 32 upstream of check valve 28 is connected between connection fitting 31 and a liquid inlet 33 of vessel 20. Preferably, as shown in the drawing, check valve 28 is disposed within transfer vessel 20, at inlet 33, so that the heat of molten sulfur in the vessel keeps the check valve from freezing up with solidified sulfur. Alternatively, although less advantageously, check valve 28 could be installed upstream of vessel 20 in conduit 32.

Connected between a liquid outlet 34 of transfer vessel 20 and pug mill 14 is a molten sulfur transfer conduit 36, exposed regions of which are preferably thermally insulated. Transfer conduit 36 includes a standpipe portion 38 which extends downwardly through vessel outlet 34 nearly to the bottom of vessel 20.

A pressurized air conduit 40 is connected between compressor 22 and a gas inlet 41 at the top of transfer vessel 20 to enable pressurization of the vessel with air from the compressor. Preferably (as depicted in the drawing) compressed air conduit 40 extends to an elevation above the top of tank truck 12 so that molten sulfur is prevented from flowing from the tank truck (or from vessel 20) into compressor 22, thereby eliminating the need for a check valve in the compressed air conduit. However, if desired, a check valve (similar to check valve 28) can additionally, or as an alternative to routing compressed air conduit 40 above the top of tank truck 12, be installed in the compressed air conduit.

An electrically controlled shutoff valve 42 (which may be electrically or pneumatically actuated) is installed in air conduit 40, such valve being controlled through an electrical conduit 44 by a control unit 45. Although control unit 45 preferably comprises a known type of timer/sequencer 46, it may alternatively (or additionally) comprise a simple, manually-operated, electrical on/off switch 47 (shown in phantom lines in the drawing).

Timer/sequencer 46 is connected for automatically cycling valve 42 on and off in accordance with a preestablished timing sequence. Such a timing sequence is determined by such factors as: (i) the amount of molten sulfur to be combined with the asphalt oil and aggregate in pug mill 14 for each batch of paving material 17 to be mixed therein, (ii) the volume of transfer vessel 20, (iii) the length of time required to gravity fill the transfer vessel with molten sulfur from tank truck 12, (iv) the length of time required to transfer each slug of molten sulfur from the transfer vessel to the pug mill, (v) the mixing time in the pug mill of the molten sulfur, asphalt oil, and aggregate for each batch of paving material 17, and (vi) the time delay (if any) between the discharge of one batch of paving material from the pug mill and the receiving of molten sulfur into the pug mill for the next batch. Control unit 46 may also be connected to compressor 22, by an electrical conduit 48, for turning the compressor on and off at the start and end of the entire pavement mixing operation.

The gravity draining of molten sulfur from transfer vessel 20 (if necessary, for example, in the event compressor 22 fails to operate or valve 42 fails to open as required after the vessel has been filled with molten sulfur) is enabled by a drain valve 50 which is connected to the bottom of the vessel by a conduit 52.

For convenience in moving apparatus 10 from place to place, transfer vessel 20 and compressor 22 may be mounted on a skid or pallet 54 (shown in phantom lines in the drawing).

OPERATION OF TRANSFER APPARATUS 10

After tank truck 12 arrives at a site where sulfur/asphalt oil/aggregate paving material 17 is to be mixed (and with tank truck shutoff valve 26, tank drain valve 50, and compressed air valve 42 all closed) transfer apparatus 10 is connected to the tank truck shutoff valve by connector 31. Compressor 22 is started and air pressure is permitted to build up in the compressor. Normally thereafter, compressor 22 is kept running, with the compressed air being vented, for example, through pressure relief conduit 23, when valve 42 in compressed air conduit 40 to transfer vessel 20 is closed.

As initial, measured amounts of aggregate and asphalt oil are being introduced into pug mill 14 in a conventional manner, valve 26 at the bottom of tank truck 12 is opened, thereby permitting molten sulfur to flow from tank truck 12 into transfer vessel 20 through check valve 28. As above-mentioned, transfer vessel 20 is physically positioned below the level of tank truck 12 to enable the gravity flow of molten sulfur from the tank truck into the transfer vessel.

After transfer vessel 20 has been filled with molten sulfur in this manner, and when molten sulfur is required by pug mill 14, compressed air valve 42 is opened, by timer/sequencer 46 of control unit 45, thereby supplying compressed air, through conduit 40, to the vessel. As compressed air is supplied to transfer vessel 20, check valve 28 between the vessel and tank truck 12 is forced closed. Check valve 28 thus prevents (without the need to close shutoff valve 26) the flow of molten sulfur back into the tank truck and enables transfer vessel 20 to be pressurized and the molten sulfur held therein to be forced, by the compressed air, from the transfer vessel, through conduit 36, into pug mill 14.

After the length of time required for compressed air from conduit 40 to force all the molten sulfur from transfer vessel 20 into pug mill 14, compressed air valve 42 is closed by timer/sequencer 46. Transfer vessel 20 then depressurizes (through conduit 36), thereby permitting check valve 28 to automatically reopen. Transfer vessel 20 then refills, through check valve 28 and shutoff valve 26, with molten sulfur from tank truck 12.

In the alternative, if only manual on-off switch 47 is provided in control unit 45, such switch is manually actuated so as to close valve 42 in compressed air conduit 40 either after a measured time interval which is sufficient to transfer the molten sulfur from vessel 20 into pug mill 14 or when it has otherwise been determined that all the molten sulfur has been forced by the compressed air from the vessel into pug mill 14. Such complete emptying of transfer tank can, for example, usually be detected by the sound of compressed air flowing through outlet conduit 36.

Pug mill 14 typically batch-mixes the aggregate, asphalt oil, and molten sulfur supplied to it, transfer vessel 20 being preferably, but not necessarily, constructed to hold the total amount of molten sulfur required for one such batch. If transfer vessel 20 holds less than the amount of molten sulfur required for mixing a batch of paving material 17 (for example, if all the required molten sulfur is not to be introduced into pug mill 14 in a single slug), more than one of the above-described fill and transfer cycle is required for each batch of paving material 17. Assuming that all factors (such as those listed above) determining the operating schedule of apparatus 10 are known in advance, timer-sequencer 46 of control unit 45 is preferably programmed so that the opening and closing of compressed air valve 42 is performed in a manner automatically transferring the required amounts of molten sulfur from tank truck 12 to pug mill 14 at the required times.

In the event, however, that automatic timer/-sequencer 46 is not provided in control unit 45, manual switch 47 controlling compressed air valve 42 can be actuated to achieve substantially the same results described above, but usually in a less convenient manner. However, if pug mill 14 is not operated in accordance with a preestablished schedule, manual operation of control unit 45 by manual switch 47 may be necessary, such switch thereby providing an optional, manual mode of operation.

From the foregoing description it is evident that the molten sulfur is transferred from vessel 20 into pug mill 14 in relatively small (compared to the volume of tank truck 12), discrete amounts or slugs, the size of each of which is determined by the volume of the transfer vessel. It is further evident that the cyclic sequence of filling transfer vessel 20 with molten sulfur from tank truck 12 and then emptying the molten sulfur from the transfer vessel into pug mill 14 is enabled solely by the respective closing and opening of valve 42 in compressed air conduit 40 (assuming, of course, that shutoff valve 26 at the bottom of the tank truck is left open). The only moving parts in apparatus 10 which are in the molten sulfur flow path are those in check valve 28.

An important advantage of apparatus 10 is that after the last slug of molten sulfur required for any pavement mixing operation has been forced (by the compressed air) from vessel 20, through molten sulfur conduit 36, to pug mill 14, both the vessel (including check valve 28) and conduit 36 are (or can readily be) swept free of the molten sulfur by the compressed air used to transfer the molten sulfur (shutoff valve 26 being closed to prevent any more molten sulfur flowing from tank truck 12 into the vessel). Consequently, apparatus 10 can be removed from operation without the necessity for draining molten sulfur therefrom or for having to heat the apparatus, or any part thereof, to a temperature above the sulfur solidification point. Should any small amount of sulfur happen to solidify in check valve 28, the next time apparatus 10 is connected to a sulfur tank truck 12 and valve 26 is opened, the heat of the molten sulfur from the truck will rapidly melt any sulfur solidified in the check valve.

A corresponding process is provided for transferring a liquid, such as molten sulfur, from a supply, such as tank truck 12, to another location, such as pug mill 14.

EXAMPLE

By way of a specific example, with no limitations being thereby intended or implied, a typical tank truck 12 holds about 3200 gallons (48,000 pounds, at about 15 pounds per gallon) of molten sulfur. A typical pug mill 14 batch-mixes about 5 tons of paving material 17 (in proportions of about 9500 pounds of aggregate, about 283 pounds of asphalt oil, and about 206 pounds of molten sulfur) in about 45–50 seconds. To provide a 206 pound slug of molten sulfur, transfer vessel 20 is about 12 inches in diameter and about 30–36 inches high, thereby having a capacity of about 14 gallons.

Shut-off valve 26 at the bottom of tank truck 12 and check valve 28 at the inlet to transfer vessel 20 are 3-inch valves. The molten sulfur discharge rate from the tank truck into the transfer vessel is typically about 200–300 gallons per minute (depending upon the sulfur head in the tank truck). The average fill time of transfer vessel 20 is thus typically less than about 5 seconds.

Compressor 22 is selected to have an output of about 10–20 cubic feet per minute at a pressure of somewhat less than 100 psig. Compressed air conduit 40 is a 2-inch pipe or flexible hose, and conduit 36, through which molten sulfur is discharged from transfer tank 20, is a 3-inch, insulated pipe. A typical time in which transfer tank 20 is emptied by compressed air from compressor 22 is about 10 seconds.

Assuming: (i) an asphalt material batch mixing time in pug mill 14 of 45 seconds, (ii) the continuous (that is, batch-after-batch) production of mixed batches of paving material 17 from the pug mill, and (iii) an emptying time of 10 seconds for transfer tank 20, timer-sequencer 46 of control unit 45 is set to automatically open valve 42 in compressed air conduit 40 every 45 seconds for about 10 seconds, so as to automatically provide a 206 pound slug of molten sulfur from vessel 20 to the pug mill every 45 seconds.

Although there has been described above a volumetric transfer apparatus for liquids, and particularly such difficult-to-handle liquids as molten sulfur, in accordance with the present invention for purposes of illustrating the manner in which the invention can be used to advantage, it is to be understood that the invention is not limited thereto. Accordingly, any and all variations and modifications which may occur to one skilled in the art are to be considered to fall within the scope and spirit of the invention as defined by the appended claims.

What is claimed is:

1. A process for transferring molten sulfur from a supply of molten sulfur to a mixing zone, said process comprising the steps of:
   (a) positioning a supply of molten sulfur above a closed transfer zone, separated from said supply of molten sulfur;
   (b) providing fluid communication between said supply of molten sulfur and said transfer zone;
   (c) providing fluid communication between said transfer zone and said mixing zone;
   (d) flowing molten sulfur from said supply of molten sulfur downward, under gravity, from said supply of molten sulfur into said transfer zone; and
   (e) pressurizing said transfer zone to force said molten sulfur from said transfer zone to said mixing zone.

2. A process according to claim 1 further comprising preventing molten sulfur from flowing from said transfer zone back to said supply of molten sulfur upon pressurizing said transfer zone.

3. A process according to claim 1 wherein said pressurizing step comprises connecting said transfer zone to a source of pressurized gas.

4. A process according to claim 3 further comprising preventing molten sulfur from flowing from said transfer zone to said source of pressurized gas.

5. A process according to claim 1 wherein said transfer zone has a volume substantially smaller than the volume of said supply of molten sulfur, such that repeating, in sequence, the steps of (i) flowing molten sulfur from said supply of molten sulfur into said transfer zone and (ii) pressurizing said transfer zone causes molten sulfur to be transferred from said supply of molten sulfur to said mixing zone in a series of discrete volumetric amounts.

6. A process for transferring molten sulfur comprising the steps of:
   (a) positioning a tank truck containing a supply of molten sulfur above a closed transfer zone, separated from said tank truck;
   (b) providing fluid communication between said supply of molten sulfur and said transfer zone;
   (c) providing fluid communication between said transfer zone and said mixing zone;
   (d) flowing molten sulfur from said supply of molten sulfur downward, under gravity, from said supply of molten sulfur into said transfer zone;
   (e) pressurizing said transfer zone to force said molten sulfur from said transfer zone to said mixing zone; and
   (f) introducing a discrete volume of asphalt into said mixing zone.

7. A process according to claim 6 further comprising preventing molten from sulfur flowing from said transfer zone back to said supply of molten sulfur upon pressurizing said transfer zone.

8. A process according to claim 7 wherein said pressurizing step comprises connecting said transfer zone to a source of pressurized gas.

9. A process according to claim 8 further comprising preventing molten sulfur from flowing from said transfer zone to said source of pressurized gas.

10. A process according to claim 9 wherein said transfer zone has a volume substantially smaller than the volume of said supply of molten sulfur, such that repeating, in sequence, the steps of (i) flowing molten sulfur from said supply of molten sulfur into said transfer zone and (ii) pressurizing said transfer zone causes molten sulfur to be transferred from said supply of molten sulfur to said mixing zone in a series of discrete volumetric amounts.

11. A process according to claim 10 wherein said source of pressurized gas is a compressor and said gas is air.

12. A process according to claim 11 further including providing a conduit in fluid communication between said compressor and said transfer zone, said conduit being positioned to have at least a portion thereof located above said supply of molten sulfur.

13. A process for mixing molten sulfur with asphalt comprising the steps of:
   (a) positioning a tank truck containing a supply of molten sulfur above a closed transfer zone, separated from said tank truck;
   (b) providing fluid communication between said supply of molten sulfur and said transfer zone;
   (c) providing fluid communication between said transfer zone and said mixing zone;
   (d) flowing molten sulfur from said supply of molten sulfur downward, under gravity, from said supply of molten sulfur into said transfer zone;
   (e) pressurizing said transfer zone with air to force said molten sulfur from said transfer zone to said mixing zone;
   (f) introducing a discrete amount of asphalt into said mixing zone; and
   (g) mixing said molten sulfur and asphalt.

14. A process according to claim 13 wherein said transfer zone has a volume substantially smaller than the volume of said supply of molten sulfur, such that repeating, in sequence, the steps of (i) flowing molten sulfur from said supply of molten sulfur into said transfer zone and (ii) pressurizing said transfer zone causes molten sulfur to be transferred from said supply of molten sulfur to said mixing zone in a series of discrete volumetric amounts.

15. A process according to claim 14 wherein said source of pressurized air is a compressor.

16. A process according to claim 15 further including providing a conduit in fluid communication between said compressor and said transfer zone, said conduit being positioned to have at least a portion thereof located above said supply of molten sulfur.

17. A process according to claim 14 further comprising preventing molten sulfur from flowing from said transfer zone back to said supply of molten sulfur upon pressurizing said transfer zone.

18. A process according to claim 17 wherein said pressurizing step comprises providing fluid communication between said transfer zone and a source of pressurized air.

19. A process according to claim 18 further comprising preventing molten sulfur from flowing from said transfer zone to said source of pressurized gas.

20. A batch process for producing a paving material comprising the steps of:
   (a) positioning a tank truck containing a supply of molten sulfur above a closed transfer zone, separated from said tank truck;
   (b) providing fluid communication between said supply of molten sulfur and said transfer zone;
   (c) providing fluid communication between said transfer zone and said mixing zone;

(d) flowing molten sulfur from said supply of molten sulfur downward, under gravity, from said supply of molten sulfur into said transfer zone;

(e) pressurizing said transfer zone with air to force said molten sulfur from said transfer zone to said mixing zone;

(f) introducing a discrete amount of asphalt and an aggregate into said mixing zone; and (g) producing a paving material by mixing said molten sulfur, asphalt and aggregate.

21. A process according to claim 20 wherein said transfer zone has a volume substantially smaller than the volume of said supply of molten sulfur, such that repeating, in sequence, the steps of (i) flowing molten sulfur from said supply of molten sulfur into said transfer zone and (ii) pressurizing said transfer zone causes molten sulfur to be transferred from said supply of molten sulfur to said mixing zone in a series of discrete volumetric amounts.

22. A process according to claim 21 wherein said source of pressurized air is a compressor.

23. A process according to claim 22 further including providing a conduit in fluid communication between said compressor and said transfer zone, said conduit being positioned to have at least a portion thereof located above said supply of molten sulfur.

24. A process according to claim 23 further comprising preventing molten sulfur from flowing from said transfer zone back to said supply of molten sulfur upon pressurizing said transfer zone.

25. A process according to claim 21 wherein said pressurizing step comprises providing fluid communication between said transfer zone and a source of pressurized air.

26. A process according to claim 25 further comprising preventing molten sulfur from flowing from said transfer zone to said source of pressurized gas.

* * * * *